US006725749B1

(12) United States Patent
Liou

(10) Patent No.: US 6,725,749 B1
(45) Date of Patent: Apr. 27, 2004

(54) TOOL INCLUDING A TOOL BIT AND A HANDLE

(76) Inventor: Mou-Tang Liou, No. 57, Kung Yeh North Road, Nan Kang Industrial Park, Nantou City, Nantou Hsien (TW)

( * ) Notice: Subject to any disclaimer, the term of this patent is extended or adjusted under 35 U.S.C. 154(b) by 0 days.

(21) Appl. No.: 10/271,274

(22) Filed: Oct. 16, 2002

(51) Int. Cl.[7] ..... B25B 23/00
(52) U.S. Cl. ..... 81/438; 81/443
(58) Field of Search ..... 81/438, 439, 443, 81/446, 455

(56) References Cited

U.S. PATENT DOCUMENTS 4,692,073 A * 9/1987 Martindell ..... 408/239 A
5,013,194 A * 5/1991 Wienhold ..... 408/240
6,148,696 A * 11/2000 Chiang ..... 81/63.1
6,199,872 B1 * 3/2001 Hasan ..... 279/30
6,325,393 B1 * 12/2001 Chen et al. ..... 279/22
6,363,819 B1 * 4/2002 Li ..... 81/438

* cited by examiner

*Primary Examiner*—Joseph J. Hail, III
*Assistant Examiner*—David B. Thomas
(74) *Attorney, Agent, or Firm*—Charles E. Baxley

(57) ABSTRACT

A tool includes a tool bit and a handle for releasable engagement with the tool bit. The tool bit includes an insert formed thereon. The handle includes a socket formed thereon. The socket includes a cavity defined therein for receiving the insert and at least one hole communicated with the cavity. The at least one hole includes an internal end and an external end larger than the internal end. The at least one annular groove defined in the insert is aligned with the at least one hole when the insert is inserted in the socket. At least one ball is received in the at least one hole. A sleeve includes an internal face and at least one cam surface formed on the internal face thereof. The sleeve is rotationally mounted on the socket between a first position and a second position. In the first position, the at least one cam surface allows complete removal of the at least one ball from the cavity. In the second position, the at least one cam surface pushes the at least one ball into the cavity.

6 Claims, 4 Drawing Sheets

TOOL INCLUDING A TOOL BIT AND A HANDLE

BACKGROUND OF INVENTION

1. Field of Invention

The present invention relates to a tool including a tool bit and a handle for releasable engagement with the tool bit.

2. Related Prior Art

A conventional hand tool includes a tool bit secured to or integrated with a handle. Therefore, a user has to carry many handles and corresponding tool bits if wanting to do various types of work. The handles are bulky and heavy to carry.

There have been devised various hand tools that each include a tool bit engaged with a handle in a releasable manner. Generally, such a tool bit includes an insert, and such a handle includes a socket for receiving the insert. A locking device is used to lock the insert in the socket.

SUMMARY OF INVENTION

It is an objective of the present invention to provide a tool including a tool bit and a handle engaged with the tool bit in a releasable manner.

According to the present invention, a tool includes a tool bit and a handle for releasable engagement with the tool bit. The tool bit includes an insert formed thereon. The handle includes a socket formed thereon. The socket includes a cavity defined therein for receiving the insert and at least one hole communicated with the cavity. The at least one hole includes an internal end and an external end larger than the internal end. The at least one annular groove defined in the insert is aligned with the at least one hole when the insert is inserted in the socket. At least one ball is received in the at least one hole. A sleeve includes an internal face and at least one cam surface formed on the internal face thereof. The sleeve is rotationally mounted on the socket between a first position and a second position. In the first position, the at least one cam surface allows complete removal of the at least one ball from the cavity. In the second position, the at least one cam surface pushes the at least one ball into the cavity.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
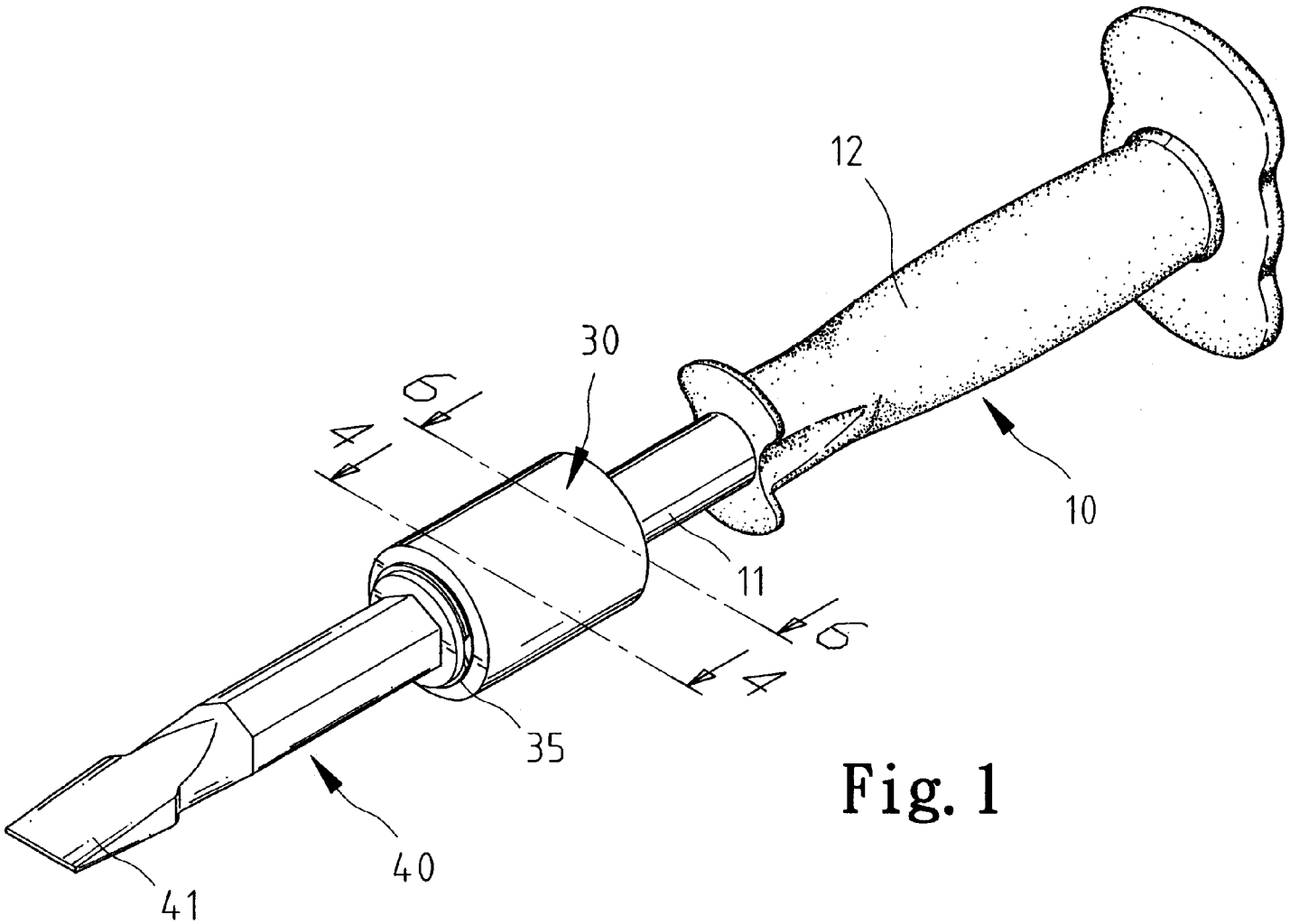
FIG. 1 is a perspective view of a tool including a tool bit and a handle for releasable engagement with the tool bit according to the present invention.

Referring to FIG. 1, according to the present invention, a tool includes a tool bit 40 and a handle 10 for releasable engagement with the tool bit 40.

Figure 2:
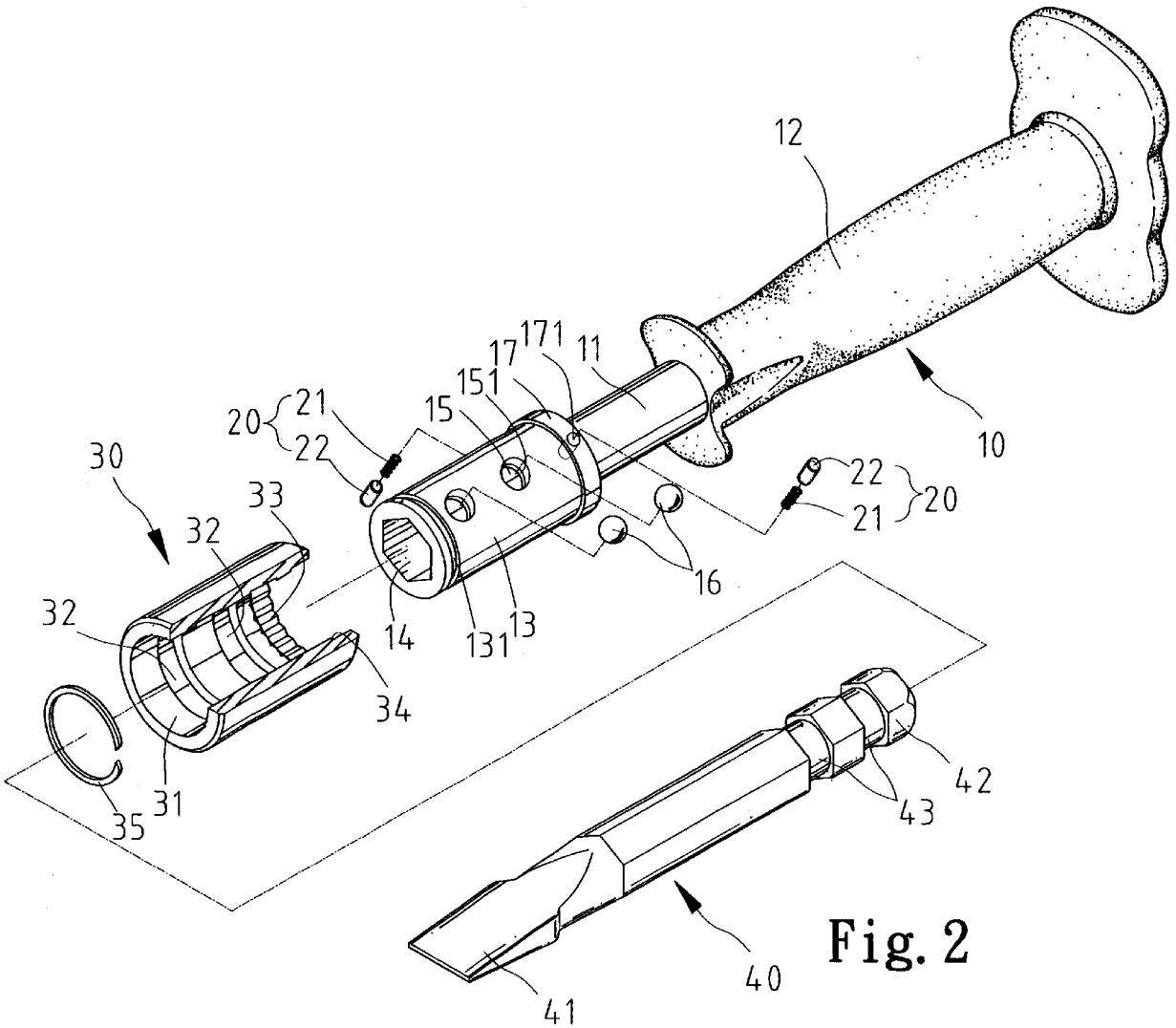
FIG. 2 is an exploded view of the tool according to the present invention.

Referring to FIG. 2, the handle 10 includes a shaft 11, a grip 12 mounted on an end of the shaft 11 and a socket 13 formed at an opposite end of the shaft 11.

The socket 13 includes a cavity 14 defined therein and two holes 15 communicated with the cavity 14 are defined. Each of the holes 15 includes an internal end at an internal face of the socket 13 and an external end at an external face of the socket 13. An annular stop 151 is formed on the wall of each of the holes 15 at the internal end. An annular groove 131 is defined in the external face of the socket 13 near an end. Two recesses 171 are defined in an annular rib 17 formed on the external face of the socket 13 at an opposite end .

As defining a hole, the sleeve 30 includes an internal face 31. Two annular grooves are defined in the internal face 31. Each of the annular grooves defined in the internal face 31 includes a bottom face 32 that is eccentric with respect to the internal face 31 and therefore will be referred to as "cam face." The internal face 31 includes, at an end, an enlarged section formed with a plurality of teeth 33. Thus, an annular shoulder 34 is formed between the enlarged section and the remaining section of the. internal face 31.

In assembly, a ball 16 is received in each of the holes 15 through the external end and is retained there by means of the annular stop 151. A spring 21 is received in each of the recesses 171 before a pin 22. Each of the pins 22 may include a recess defined in an end in order to receive an end of one of the springs 21. The socket 13 is inserted in the sleeve 30. The pins 22 are aligned with the teeth 34. Each of the holes 15 is aligned with one of the cam faces 32. The annular groove 131 is positioned beyond the sleeve 30. The annular shoulder 33 is positioned against the annular rib 17, and a C-ring 35 is received in the annular groove 131. Thus, the sleeve 30 is retained on the socket 13. The sleeve 30 is rotational on the socket 13.

The tool bit 40 includes a working head 41 formed at an end and an insert 42 formed at an opposite end. The profile of the insert 42 is shaped corresponding to the internal face of the socket 13.

The engagement of the tool bit 40 with the handle 10 will be described referring to FIGS. 3~5.

Figure 3:
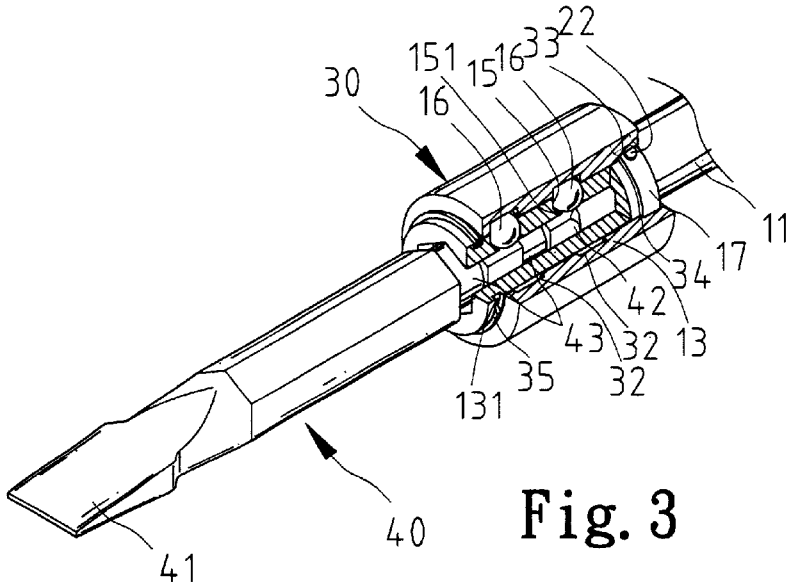
FIG. 3 is a partial perspective view of the tool according to the present invention, with the handle broken so as to show some internal elements.
Figure 4:
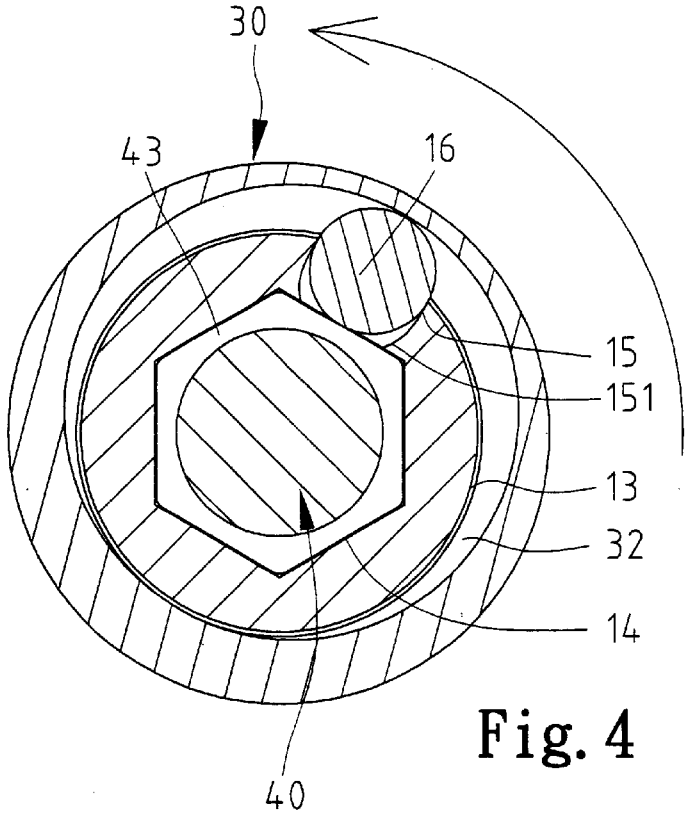
FIG. 4 is a cross-sectional view taken along a line 4—4 in FIG. 1.

To insert the insert 42 in the socket 13, the sleeve 30 is located on the socket 13 in an angular position shown in FIGS. 3 and 4. A point in each of the cam surfaces 32 that is furthest from an axis of the sleeve 30 is aligned with one of the balls 16. Each of the balls 16 is allowed complete removal from one of the holes 15. The insert 42 can thus be inserted in the socket 13 and vice versa. When the insert 42 is inserted in the socket 13, each of the annular grooves 43 is aligned with one of the holes 15.

Figure 5:
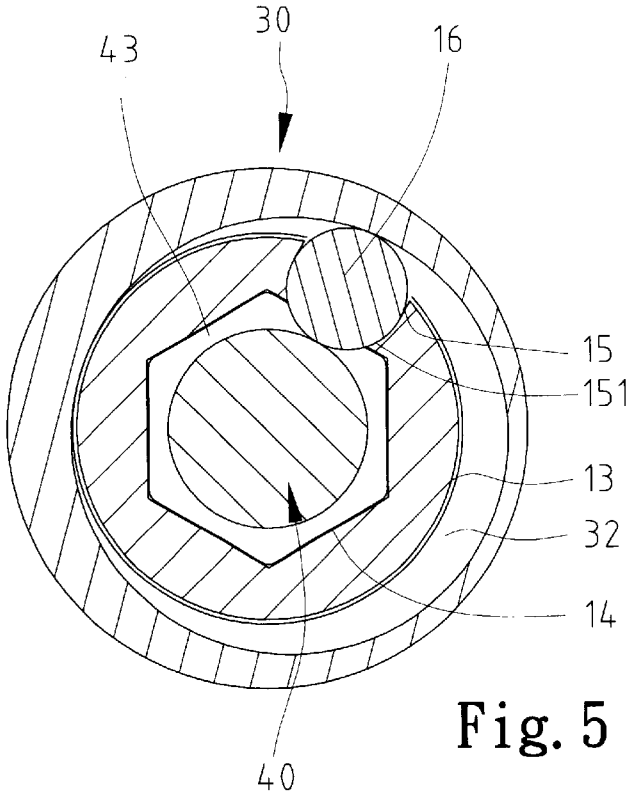
FIG. 5 is similar to FIG. 4, but showing the tool in a different position.

To lock the insert 42 in the socket 13, the sleeve 30 is rotated on the socket 13 to an angular position shown in FIG. 5. A point in each of the cam surfaces 32 that is not furthest from an axis of the sleeve 30 is aligned with one of the balls 16. Each of the balls 16 is pushed, on a side, by means of the point of each of the cam faces 32 and is thus inserted, on a opposite end, in one of the annular grooves 43. Thus, the insert 42 is locked in the socket 13.

Figure 6:
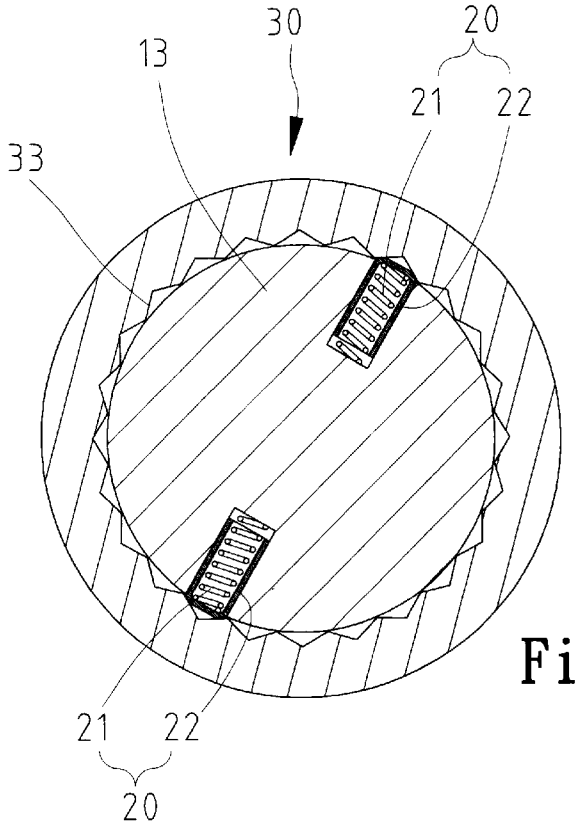
FIG. 6 is a cross-sectional view taken along a line 6—6 in FIG. 1.

Referring to FIG. 6, to retain the socket 30 in an angular position on the socket 13, an end of each of the pins 22 is trapped between two of the teeth 34. The end of each of the pins 22 trapped between two of the teeth 34 is substantially flat in the shown embodiment; however, it may be shaped corresponding to the teeth 34 in other embodiments for better engagement with the teeth 34.

The present invention has been described via detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A tool including a tool bit including an insert formed thereon; and a handle including:

a socket formed thereon, the socket including a cavity defined therein for receiving the insert and at least one hole communicated with the cavity, the at least one hole including an internal end and an external end larger than the internal end, wherein the at least one annular groove defined in the insert is aligned with the at least one hole when the insert is inserted in the socket;

at least one ball received in the at least one hole;

a sleeve including an internal face and at least one cam surface formed on the internal face thereof, wherein the sleeve is rotationally mounted on the socket between a first position wherein the at least one cam surface allows complete removal of the at least one ball from the cavity and a second position wherein the at least one cam surface pushes the at least one ball into the cavity.

2. The tool according to claim 1 including an annular stop formed at the internal end of the at least one hole.

3. The tool according to claim 1 including a C-ring mounted on an end of the socket for restricting axial movement of the sleeve on the socket.

4. The tool according to claim 3 wherein the socket includes an annular groove defined in an external face for receiving the C-ring.

5. The tool according to claim 1 wherein the socket includes an annular rib formed on the external face for restricting axial movement of the sleeve on the socket.

6. The tool according to claim 1 including at least one spring-biased pin mounted on an internal face of the socket, wherein the sleeve including a plurality of teeth formed on an internal face for trapping the at least one spring-biased pin.

* * * * *